US010520895B2

(12) United States Patent
Kim

(10) Patent No.: US 10,520,895 B2
(45) Date of Patent: Dec. 31, 2019

(54) SMART WATCH THAT CHANGES COLOR OF STRAP ACCORDING TO MOOD OF USER

(71) Applicant: HANCOM, INC., Seongnam-si, Gyeonggi-do (KR)

(72) Inventor: Sang Cheol Kim, Namyangju-si (KR)

(73) Assignee: HANCOM, INC., Seongnam-si, Gyeonggi-do (KR)

( * ) Notice: Subject to any disclaimer, the term of this patent is extended or adjusted under 35 U.S.C. 154(b) by 0 days.

(21) Appl. No.: 15/771,387

(22) PCT Filed: Oct. 20, 2016

(86) PCT No.: PCT/KR2016/011851
§ 371 (c)(1),
(2) Date: Apr. 26, 2018

(87) PCT Pub. No.: WO2017/073960
PCT Pub. Date: May 4, 2017

(65) Prior Publication Data

US 2018/0335756 A1 Nov. 22, 2018

(30) Foreign Application Priority Data

Oct. 28, 2015 (KR) ..... 10-2015-0150568

(51) Int. Cl.
*G04B 45/00* (2006.01)
*G04G 21/02* (2010.01)
*G04G 21/04* (2013.01)

(52) U.S. Cl.
CPC ..... *G04B 45/0015* (2013.01); *G04G 21/025* (2013.01); *G04G 21/04* (2013.01)

(58) Field of Classification Search
CPC ..... G04B 45/0015; G04G 21/025
(Continued)

(56) References Cited

U.S. PATENT DOCUMENTS 9,064,390 B1 * 6/2015 Clark ..... G08B 5/36
9,974,481 B2 * 5/2018 Dugan ..... A61B 5/02
(Continued)

FOREIGN PATENT DOCUMENTS

CN 104824931 A 8/2015
KR 10-1395614 B1 5/2014
(Continued)

OTHER PUBLICATIONS

International Search Report for PCT/KR2016/011851 dated Jan. 12, 2017 from Korean Intellectual Property Office.

*Primary Examiner* — Ojiako K Nwugo
(74) *Attorney, Agent, or Firm* — Revolution IP, PLLC

(57) ABSTRACT

A smart watch having a strap changing in color according to a user's mood, the smart watch includes: a body that collects information on a measurement target associated with a user or around the user to write state information, compares the state information with state combination information in which a plurality of pieces of combination information and a displayed color for each of the plurality of pieces of combination information are determined, selects one piece of corresponding combination information from among the plurality of pieces of combination information included in the state combination information, and selects a displayed color matching the selected combination information; and a strap that is connected with the body to fix the body to a user's body part, includes an output means of the displayed color, and outputs the displayed color through the output means according to a control of the body.

3 Claims, 4 Drawing Sheets

(58) Field of Classification Search
USPC ..... 340/573.1
See application file for complete search history.

(56) References Cited

U.S. PATENT DOCUMENTS

2006/0261958 A1* 11/2006 Klein ..... A01K 11/006 340/572.8
2008/0004510 A1* 1/2008 Tanzawa ..... A44C 5/0015 600/301
2008/0190138 A1* 8/2008 DiCiacco ..... G01K 11/165 63/14.9
2009/0151395 A1* 6/2009 Louk ..... A44C 9/0023 63/15.1
2011/0254225 A1* 10/2011 Doherty ..... A44B 5/002 273/287
2012/0306643 A1* 12/2012 Dugan ..... A61B 5/02 340/539.12
2015/0033794 A1* 2/2015 Ma ..... A44C 15/0015 63/1.13
2015/0051501 A1* 2/2015 Dugan ..... A61B 5/02 600/483
2015/0164390 A1* 6/2015 Larvenz ..... A61B 5/14532 600/365
2015/0213002 A1* 7/2015 Gou ..... G06F 17/2785 704/9
2015/0351681 A1 12/2015 Lee et al.
2016/0179198 A1* 6/2016 Levesque ..... G06F 3/016 340/407.1
2016/0357413 A1* 12/2016 Block ..... G06F 3/0482

FOREIGN PATENT DOCUMENTS

KR 10-2015-0029453 A 3/2015
KR 10-1525330 B1 6/2015
KR 10-1554188 B1 9/2015

* cited by examiner

【FIG. 1】
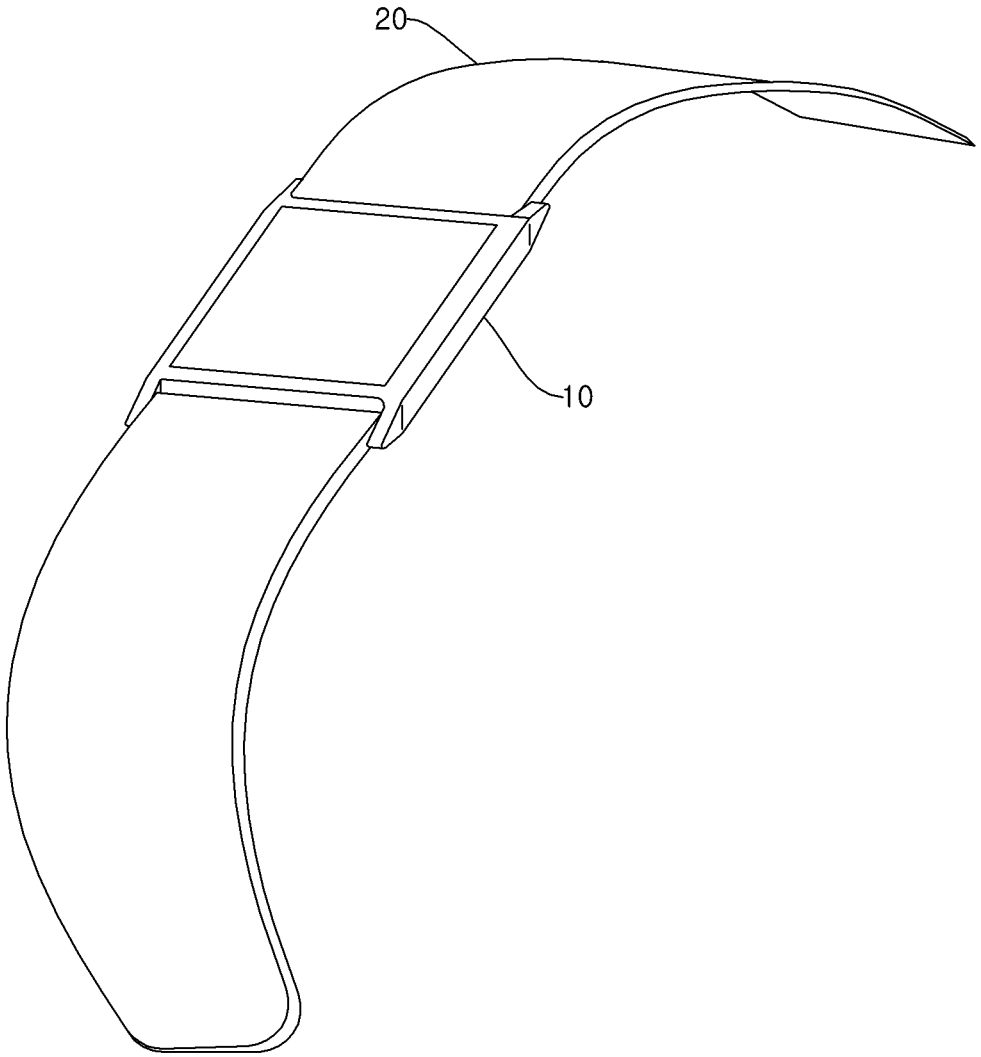

【FIG. 2】
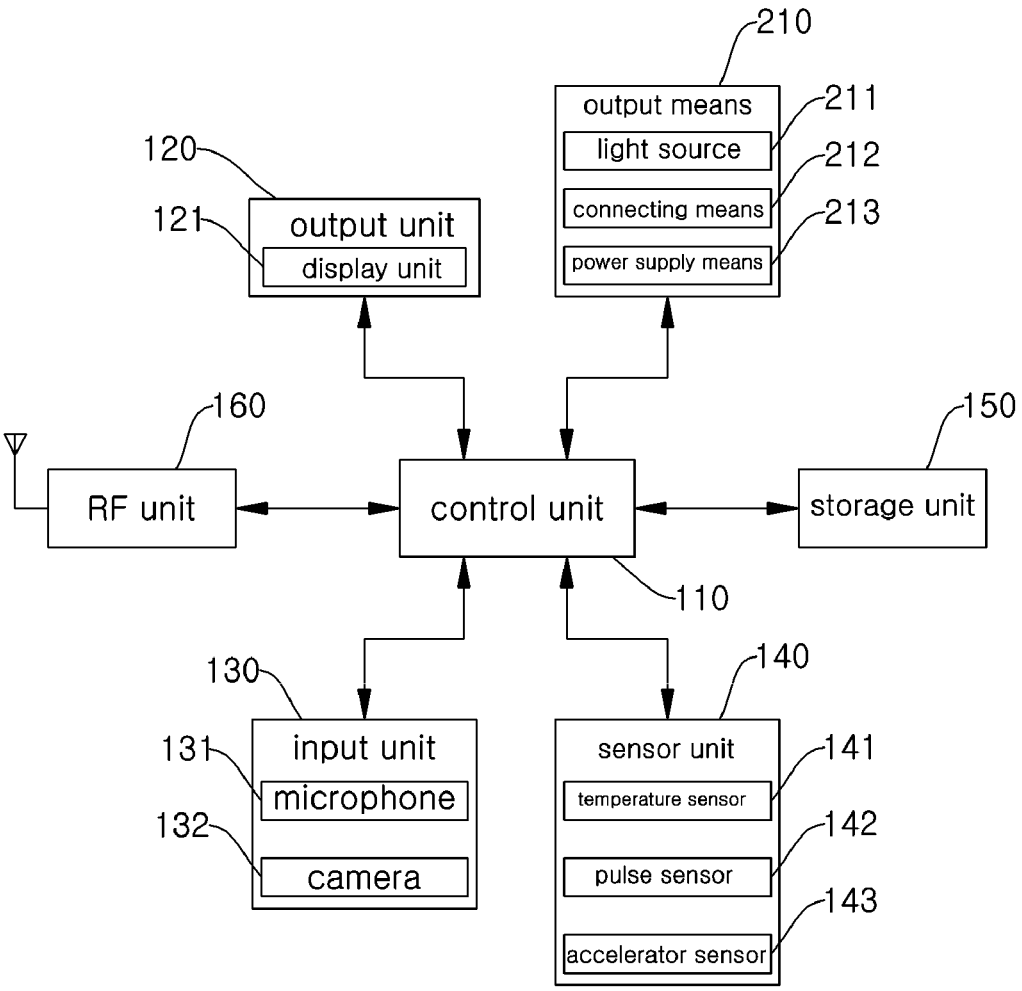

【FIG. 3】

| measurement target | | state combination | displayed color |
|---|---|---|---|
| face color | red(a1) | a1b1c1d1e1f1g1h1 | blue |
| | normal(a2) | a1b1c1d1e1f1g1h2 | dark blue |
| | pale(a3) | a1b1c1d1e1f1g1h3 | red |
| pupil shape | enlarged(b1) | a1b1c1d1e1f1g2h1 | dark red |
| | reduced(b2) | a1b1c1d1e1f1g2h2 | light red |
| pulse | fast(c1) | . | . |
| | normal(c2) | . | . |
| | slow(c3) | . | .. |
| body | high(d1) | . | |
| | normal(d2) | . | . |
| | low(d3) | . | . |
| voice | excited(e1) | . | . |
| | calm(e2) | . | . |
| ambient brightness | bright(f1) | . | . |
| | normal(f2) | . | . |
| | dark(f3) | . | . |
| ambient temperature | high(g1) | . | . |
| | normal(g2) | . | . |
| | lpw(g3) | . | . |
| activity | fast movement(h1) | . | . |
| | slow movement(h2) | . | . |
| | no movement(h3) | . | . |

【FIG. 4】
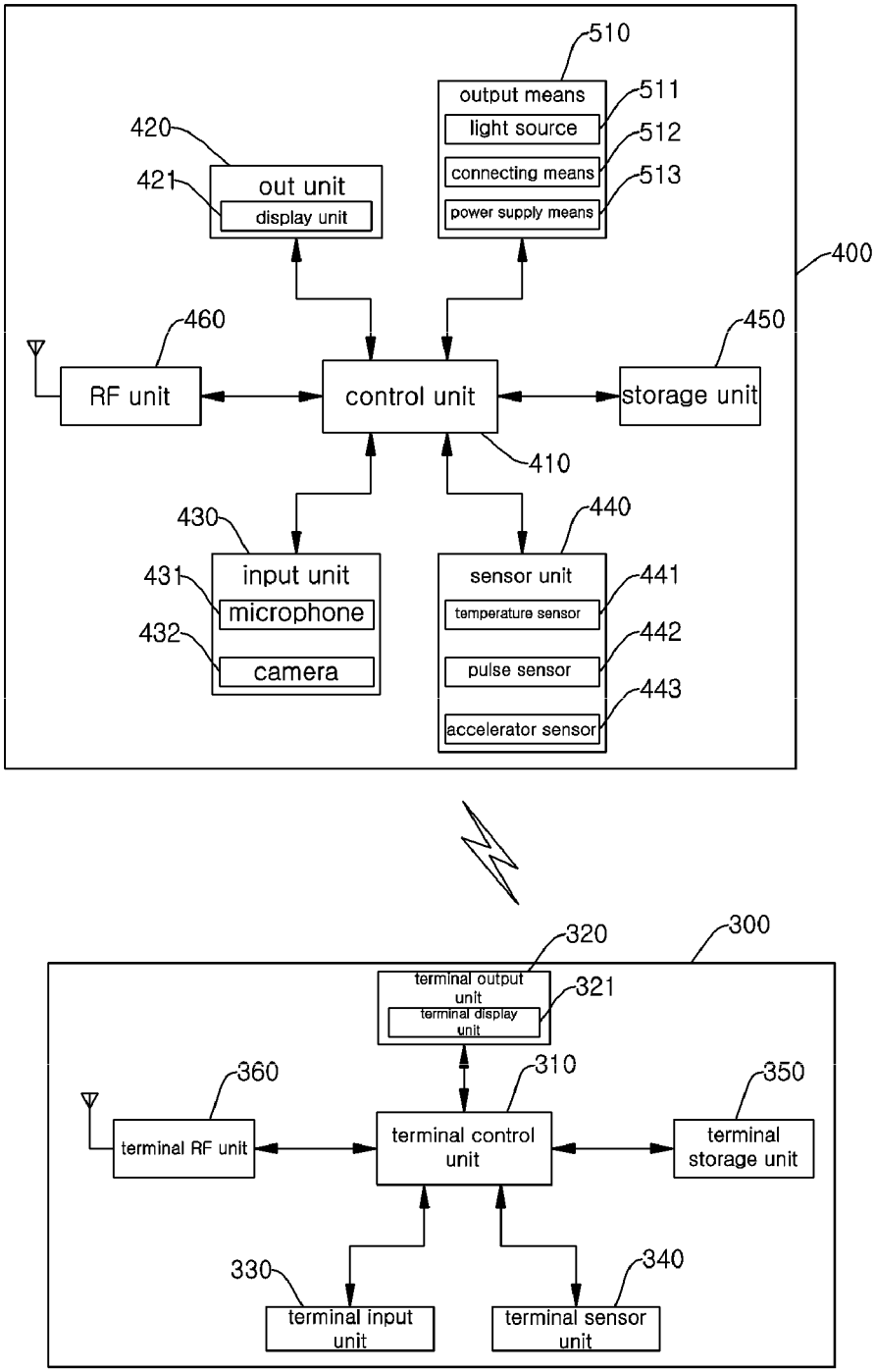

SMART WATCH THAT CHANGES COLOR OF STRAP ACCORDING TO MOOD OF USER

TECHNICAL FIELD

The present invention relates to a smart watch of a wearable device playing an auxiliary role to a master terminal and, more particularly, to a smart watch having a strap changing in color according to a user's mood, the smart watch measuring the user's mood or state in various methods, and changing a displayed color in a strap of a wearable auxiliary device according to the user's mood, thereby allowing the user to express individuality via the wearable auxiliary device and diverting or improving the mood of the user using the displayed color.

BACKGROUND ART

In recent years, mobile terminal devices such as smart phones, tablets, and smart pads have become electronic devices that people most often come into contact with, carry, and use. Such a mobile terminal is already functionally expanded beyond the function of a landline telephone, which has merely been used for a call, and is now used as a multipurpose device. That is, recent mobile terminals are used as functional devices that provide specific functions according to use purpose of the user, and are also used as amusement equipment that has an important role in the leisure industry.

With this tendency, the functions of the mobile terminal are becoming more complicated and various, and the size of the mobile terminal is becoming larger. As a result, convenience resulting from portability and compactness of the mobile terminal is gradually deteriorating.

In order to solve such inconvenience, the use of an auxiliary terminal that allows some of the functions of the mobile terminal to be performed is increasing.

The auxiliary terminal is generally referred to as a wearable device and is mainly used in a form such as a wristwatch, a spectacle, and a necklace. Especially, the smart watch in a form of a wrist watch is most commonly used among various forms.

Since the smart watch is manufactured in the form of a watch and is used to be worn by the user, the overall shape is frequently exposed to the user as compared with the mobile terminal or other wearable devices, and the exposure time is relatively longer than that of the other devices. Generally, the mobile terminal is stored in a pocket or a bag while moving, whereas the smart watch is used while being worn on the body, whereby the user can frequently check the smart watch, and thus the number of times that the watch is exposed increases and the exposure time thereof is long.

However, even if the auxiliary terminal has excellent design and usability, because the user frequently comes in contact therewith, he/she can become easily bored with the design of the auxiliary terminal. Also, due to the characteristics of mass-produced products, it is difficult for the user to express his/her own characteristics via the watch.

DISCLOSURE

Technical Problem

Accordingly, the present invention has been made keeping in mind the above problems occurring in the prior art, and an object of the present invention is to provide a smart watch having a strap changing in color according to the user's mood, in which the user's mood or state is measured by various methods, and a displayed color in a strap of a wearable auxiliary device is caused to change according to the user's mood, thereby expressing individuality of the wearable auxiliary device and diverting or improving the user's mood using the displayed color.

Technical Solution

In order to accomplish the above object, the present invention provides a smart watch having a strap changing in color according to a user's mood, the smart watch includes: a body that collects information on a measurement target associated with a user or around the user to write state information, compares the state information with state combination information in which a plurality of pieces of combination information and a displayed color for each of the plurality of pieces of combination information are determined, selects one piece of corresponding combination information from among the plurality of pieces of combination information included in the state combination information, and selects a displayed color matching the selected combination information; and a strap that is connected with the body to fix the body to a user's body part, includes an output means of the displayed color, and outputs the displayed color through the output means according to a control of the body.

The body may include a sensor unit configured with at least one of a temperature sensor, a pulse sensor, a blood pressure sensor, an accelerator sensor, a GPS sensor, a gyro sensor, and an optical sensor, or an input device including a camera or a microphone, in order to collect the state information.

The body may further include a control unit, in which the control unit receives a measured value obtained by measuring each of a plurality of measurement targets from the sensor unit or the input unit, divides the measured value into grades for each of the measurement targets, combines the measured values divided into grades for each of the measurement targets, and writes the state information.

The body may further include a storage unit, in which the storage unit stores a predetermined reference value for each of the measurement targets to be divided into the grades, and the control unit compares the reference value with the measured value to be divided into the grades.

The combination information is an expected value of the state information that is computable by combining the grades of the respective measured values for each of the plurality of measurement targets.

The output means is configured to include a light source capable of outputting one or more colors according to the control, a power supply means supplying power to the light source, and a connecting means connecting the light source and the power supply means, and the strap has at least one of the light source, the power supply means, and the connecting means embedded inside or attached to a surface thereof.

The strap may be formed with a transparent or translucent light guiding material that allows light from the light source to be diffused and emitted from the strap.

The present invention may further include an RF unit for performing communication with a mobile terminal of a master device, in which the mobile terminal performs at least one process of the measuring, the dividing of the measured values into grades, the comparison of the state information and the state combination information, and the determination of the displayed color, and the smart watch receives process results from the mobile terminal via the RF unit.

Advantageous Effects

According to the present invention, the smart watch having a strap changing in color according to the user's mood is configured such that the user's mood or state is measured by various methods, and a displayed color in a strap of a wearable auxiliary device is caused to change according to the user's mood, thereby expressing an individuality of the wearable auxiliary device and diverting or improving the user's mood using the displayed color.

DESCRIPTION OF DRAWINGS

FIG. 1 is an exemplary diagram showing a configuration of a smart watch having a strap changing in color according to the user's mood according to a first embodiment of the present invention.

FIG. 2 is an exemplary configuration diagram showing a configuration of a body in more detail.

FIG. 3 is an exemplary diagram for explaining the state combination information of the present invention and the determination of the displayed color via the state combination information.

FIG. 4 is a diagram illustrating a configuration of a smart watch having a strap changing in color according to the user's mood according to a second embodiment of the present invention.

BEST MODE

Hereinafter, preferred embodiments of the present invention will be described with reference to the accompanying drawings so that those skilled in the art can easily carry out the present invention. It should be noted that the same reference numerals denote the same elements throughout the accompanying drawings. In the following description of the present invention, detailed description of known functions and configurations incorporated herein will be omitted when it may make the subject matter of the present invention unclear, certain features shown in the drawings are to be enlarged or reduced or simplified for ease of explanation, and the drawings and their components are not necessarily drawn to scale. However, those skilled in the art will readily understand these details.

In addition, although the smart watch is typically described in the present invention, it is possible to easily apply the technique of the present invention based on the present invention in the case of a wearable assistant device, and may be easily applied to other wearable assistant devices.

FIG. 1 is an exemplary diagram showing a configuration of a smart watch having a strap changing in color according to the user's mood according to a first embodiment of the present invention. FIG. 2 is an exemplary configuration diagram showing a configuration of a body in more detail.

Referring FIGS. 1 and 2, the smart watch having a strap changing in color according to the user's mood according to a first embodiment of the present invention is configured to include a body 10 and a strap 20.

The body 10 communicates with a mobile terminal, and executes a partial function of the mobile terminal. The body 10 is fixed to a user's body using the strap 20. In particular, in the present invention, the body 10 performs measurement on a predetermined measurement target in order to analyze the state of the user, analyzes the measured values, and compares them with predetermined state combination information, thereby determining the displayed color. Then, the body 10 controls the output means so that the displayed color may be output via the strap 20.

To this end, the body 10 is configured to include a control unit 110, an output unit 120, an input unit 130, a sensor unit 140, a storage unit 150, and an RF unit 160, and may include a part of an output means 210.

The control unit 110 performs various processes for controlling the functions of the smart watch. In particular, the control unit 110 is responsible for analyzing the measured values transferred through the input unit 130 or the sensor unit 140, comparing the analyzed values with state combination information stored in advance to determine a displayed color, and controlling the output means 210 via the determined displayed color to control the displayed color of the strap.

The control unit 110 analyzes the state of the user wearing the smart watch by data input from the input unit 130 or the sensor unit 140, determines the displayed color according to the user's state depending on analysis results, and then controls the output means 210 so that the strap 20 outputs the selected displayed color. In more detail, the control unit 110 collects user information sensed from the input unit 130 or the sensor unit 140 to determine whether the user feels anger, excitement, motivation due to exercise, depression, boredom, good feelings, or another state. Then, the control unit 110 determines the displayed color through the analysis results, thereby causing the current state of the user to be maintained longer, or be switched to another state thereby outputting another displayed color.

Specifically, when a user needs to calm down, such as when he or she feels anger, or excessive excitement, a calming color such as purple, blue, or green may be determined as the displayed color. Meanwhile, when the user is in a good or pleasant state, the control unit 110 may select the displayed color to be yellow or red in order to longer sustain and further stimulate the state.

Specifically, the control unit 110 first determines the grades of the measured values for the measurement targets transferred through the input unit 130 or the sensor unit 140. To this end, the storage unit 150 stores reference values for determining the grade of the measured value in advance and the grades corresponding to the reference values. The control unit 110 compares the measured value for each measured target with the reference value, determines the grade corresponding to each measured value, and combines the measured values having the grade determined to generate the state information. In particular, since the reference value may be different for each user, some reference values may be corrected by measured values that are measured for a certain period of time or collected continuously for the user.

The control unit 110 compares the state information and the state combination information to search combination information included in the state combination information for combination information corresponding to the state information, and confirms the displayed color that is matched to the found combination information to be stored. Herein, the state combination information means a plurality of pieces of combination information and display color information matched to each piece of combination information, which is configured in a lookup table or the like. In particular, the combination information is a combination of various states that may be expected when the measured values of the respective measurement targets are combined, and is used to be compared with the state information. This will be described in more detail with reference to the following drawings.

For example, the body temperature and pulse may be exemplified as information capable of determining the state of the user. When the body temperature and the pulse become the measurement target, the measured values are obtained by measuring the measurement targets. When the measured value is received from the input unit 130 or the sensor unit 140, the controller compares the measured value with the reference value to determine whether the body temperature is high, normal, or low, and determines whether the pulse is fast, normal, or slow. For example, as a result of measurement, when the user's body temperature is in the normal range but the pulse is fast, the state information is written with contents of 'normal body temperature, fast pulse'. Then, this state information is compared with the combination information of the state combination information. When the measured target is body temperature and pulse, the combination information included in the state combination information may be composed of 9 types. In other words, the measured values of the measured target are divided into the following categories such as 'high body temperature, fast pulse', 'high body temperature, normal pulse', 'high body temperature, slow pulse', 'normal body temperature, fast pulse', and 'normal body temperature, normal pulse' which are combined according to the grades of the measured values of the measured targets. The state combination information is written by specifying the displayed color that is matched to the combination information. The control unit 110 searches the combination information written in the state combination information for combination information corresponding to 'normal body temperature, fast pulse', and confirms the displayed color that is matched to the found combination information and stored, thereby controlling the output means.

Particularly, the control unit 110 may understand accurate states of the user, using direct indicators that may be sensed by the sensor unit 140 to analyze the state of the user, such as temperature, pulse, blood pressure, activity, and indirect indicators that may be measured by the sensor unit 140 or the input unit 130, such as surrounding brightness and ambient temperature, together with the state information.

In the input unit 130, an input such as user commands and external information is performed. To this end, the input unit 130 includes a microphone 131 and a camera 132, and further includes input means such as a touch screen. The input unit 130 collects data on a measurement target that may be helpful in analyzing the user's state and transmits the collected data to the control unit 110. For example, the input unit 130 may transfer information such as a user's face color, surrounding brightness, pupil image, and voice to the control unit 110 as a measured value.

The sensor unit 140 collects and transmits various data for performing the function of the smart watch, senses a measurement target for analyzing the state of the user, and transfers the sensed measured values to the control unit 110. To this end, the sensor unit 140 may be configured to include a temperature sensor 141, a pulse sensor 142, an acceleration sensor 143, and an equivalent sensor thereof.

The temperature sensor 141 measures the body temperature in contact or non-contact manner with the user's body and, if necessary, measures the temperature around the user. The pulse sensor 142 measures the user's pulse and blood pressure and transfers it to the control unit 110. The acceleration sensor 143 measures the degree of movement of the user and transmits the measured value to the control unit 110. The acceleration sensor 143 may be replaced with a gyro sensor (not shown) and a GPS receiver (not shown), but the present invention is not limited thereto.

The storage unit 150 stores various programs for executing the smart watch, and data generated when the smart watch is executed. In particular, the storage unit 150 stores, for each measurement target, a reference value that is used for the control unit 110 to divide the measured values into grades, and the reference value is updated by data transferred through the control unit 110 as needed. Also, the storage unit 150 stores state combination information. This state combination information is composed of a plurality of pieces of combination information and a displayed color configured to be matched to each piece of combination information as described above.

The RF unit 160 makes up a communication channel for communication between the smart watch and the mobile terminal. The RF unit 160 exchanges data between the mobile terminal and the smart watch through a wireless local area communication channel such as Bluetooth or Wi-Fi.

The output means 210 outputs the displayed color under the control of the control unit 110 to change the color of the strap 20. The output means 210 includes a multicolor light source 211 capable of emitting various colors so as to output the displayed color, a power supply means 213 for supplying power to the light source 211, and a connecting means 212 for connecting the power supply means 213 and the light source 211. Although the light source 211 is configured in the strap 20 and the power supply means 213 is provided in the body 10, the present invention is not limited thereto. Specifically, the light source 211 may include a light emitting diode (LED) and may be embedded in the strap 20 or attached to a surface thereof. Herein, although the LED light source may include a LED emitting light of multiple colors from one light source or a plurality of single-color LEDs emitting light of single color for each color according to the control, the present invention is not limited thereto. Alternatively, as a surface light source, an OLED module may be embedded in the strap 20 or attached to the outside.

The power supply means 213 supplies power to the light source 211 under the control of the control unit 110 as described above. The power supply means 213 may be a battery configured in the body 10. Alternatively, the power supply means 213 may be configured in the strap 20 as a form of a battery, or a magnetic induction coil may be configured in the body and the strap to supply power source of the body 10 to the strap 20 in a magnetic induction manner, but is not limited thereto.

The connecting means 212 differs according to the configuration methods of the light source and the power supply means 213, and serves as a route for connecting the light source 211 and the power supply means 213 to transfer the power source supplied from the power supply means 213 to the light source 211. When both the power supply means 213 and the light source 211 are configured in the strap 20, they are configured in a form of a general wire or a flat cable form to be embedded in the strap 20 or attached to the outer surface thereof. In particular, when the power supply means 213 is configured in the body 10 and the light source 211 is configured in the strap, the connection portion between the strap 20 and the body 10 is configured such that the power may be supplied while the strap 20 is allowed to be movable. Since such a configuration may be implemented in various forms, a detailed description thereof will be omitted in the present invention.

The strap 20 fixes the body 10 to the wearer's body, and outputs the displayed color under the control of the control unit 110. To this end, the light source 211 and the connecting means 212 are configured inside or outside the strap 20 as described above, and in some cases the power supply means 213 may be also configured in the strap 20. The strap 20 may allow the light to be efficiently emitted from the light source 211 when the light source 211 is embedded therein. A hole may be formed in such a manner that the light source 211 is exposed, or a part or the whole of the strap 20 may be made of a synthetic resin having a transparent or translucent light guiding function. That is, the strap 20 having a light guiding function may be made of a diffusing material that allows a part of light emitted from the light source 211 to be discharged to the outside and some part thereof to flow along the strap 20, but the present invention is not limited thereto. Although a synthetic resin such as polyimide, acryl series, or silicone series may be used as a synthetic resin that forms such a strap, the present invention is not limited thereto, and any materials may be used if they perform functions of providing mechanical strength, light diffusion, and light guiding.

FIG. 3 is an exemplary diagram for explaining the state combination information and the determination of the displayed color via the state combination information according to the present invention.

Referring to FIG. 3, the smart watch of the present invention collects information on the state of the user, analyzes the information, determines the state of the user, and then changes and provides the displayed color of the strap 20 of the smart watch according to the determination result. Accordingly, the smart watch of the present invention plays a role of keeping the user's good mood or helping alleviate a bad mood or state of the user within a short time. Along with this, changing the color of the strap 20 using the displayed color may provide a new feeling for a smart watch user who may be easily bored, whereby the user will want to use the smart watch for a long time.

To this end, the smart watch of the present invention determines the state of the user as accurately as possible based on the information input through the input unit 130 and the sensor unit 140 as described above. Then the smart watch determines the displayed color of the smart watch based on the determination result and controls the light source, so that the displayed color of the strap 20 changes.

The present invention is provided to measure various measurement targets that may confirm a user's state to determine the displayed color according to a user's state, and utilize state information of the user collected through the measurement. Specifically, measured values are obtained using direct indicators that directly represent the user's state such as body temperature, face color, pupil shape, pulse, blood pressure, and voice state, and indirect indicators such as ambient brightness, ambient temperature, and activity, as the measurement targets.

The measurement target such as face color, pupil shape, and ambient brightness may be measured using a camera configured in the smart watch and a light sensor module configured in the camera, and the body temperature and the ambient temperature may be measured using a temperature sensor configured in the smart watch. In addition, the pulse may be measured using a pulse sensor, and the activity may be measured using an acceleration sensor, a GPS sensor, and a gyro sensor. In addition, if different types of sensors are configured in the smart watch so that measured values thereof may be used to analyze the state of the user, it is possible to use measured values measured by these sensors.

The smart watch according to the present invention may measure various measurement targets and analyze the measured values to accurately understand the state of the user using various kinds of sensors 40 and input devices, and accordingly the optimum display color may be determined and output, thereby improving functional or aesthetic effects.

Specifically, as shown in FIG. 3, the user's state expected by dividing the measured values of the measurement targets into grades according to the reference value, that is, combination information is configured to include a plurality of pieces of combination information, and the optimal displayed color matched to each combination information is determined and stored. A pair of such combination information and displayed color may be stored in the storage unit 150 in a form of a lookup table. In other words, by determining the number of all cases and the displayed color of each case, the control unit 110 may accurately and quickly determine the user's state by a simple analysis, thereby efficiently controlling the displayed color.

The state information constituted by combining measured values for determining the displayed color through the combination information is divided into grades for each measured value using the reference values. That is, when the measured values for a plurality of the measurement targets are respectively obtained, the control unit 110 determines to which grade the measured value belongs by using the reference values provided for each measurement target, collects the determination results, and writes the state information. Herein, the written state information is formed in the same form as the combination information, and the state information is compared with the combination information to confirm the displayed color that must be currently output.

As shown in FIG. 3, the division method of the measurement targets is provided such that the face color is divided into red (a1), normal (a2), and pale (a3), the pupil shape is divided into enlarged (b1) and reduced (b2), the pulse is divided into fast (c1), normal (c2), and slow (c3), the body temperature is divided into high (d1), normal (d2), and low (d3), the voice is divided into excited (e1) and calm (e2), the ambient light is divided into bright (f1), normal (f2), and dark (f3), the ambient temperature is high (g1), normal (f2), and low (f3), and the activity is fast movement (h1), slow movement (h2), and no movement (h3). In this way, it is possible to accurately predict the user's state by segmenting the values of the measurement target 110 and combining the segmented values.

For example, when analyzing the state of a user depending on only one of the measurement targets 110, the user's state may be erroneously determined and thus the displayed color may be erroneously presented, thereby degrading the functional and aesthetic intensions. For example, when the user's state is determined only by the user's body temperature, it is difficult to confirm whether the user's body temperature is increased due to exercise, high room temperature, illness, or anger. Generally, in most cases, it is possible to calm down the user by providing a blue or green color, but in the case of a rise in body temperature even in a good state, providing the blue or green color will result in disturbing the user from continuing to feel good.

Therefore, according to the present invention, various indicators that may be measured from the user are measured, and each of the measured indicators is divided into grades, whereby it is possible to accurately analyze what emotional state the user is in, what activity state the user is in, and the like, even under a similar state, depending on the combination of each grade. Then, the displayed color determined depending on each state is output, thereby improving functional and aesthetic effects.

The control unit 110 divides the measured value input from each sensor of the input unit 130 or the sensor unit 140 into grades according to the predetermined reference. That is, when data obtained by capturing a face via a camera is transferred, the face color is compared with a previously prepared image to determine a grade of the data. Likewise, in the case of the pupil shape, it is also checked whether the pupil is enlarged or not by comparing an image captured in advance with the data provided through the camera. In this manner, the control unit 110 compares the reference value stored in the storage unit 250 in advance with the measured value input through the input unit 130 and the sensor unit 140, and selects a grade for the measurement target. The measurement targets that are divided into grades in this way are combined and written into the state information.

Specifically, as shown in FIG. 3, the combination information is represented, such as a1b1c1d1e1f1g1h1 indicating a state in which a face color is red, a pupil is enlarged, a pulse is fast, a body temperature is high, a voice is excited, the ambient light is bright, the ambient temperature is high, and the user's activity is fast movement. Then, the displayed color 130 is determined as a state in which the user exercises outdoors, so that the displayed color 130 may be determined as a green color that may allow the tension of the exercise to be reduced. The grades of the respective measurement targets may be determined by comparing the measured values with the reference values, and the grades determined for the respective measurement targets are combined, so that the state information is written in a form of the combination information, such as "a1b1c1d1 . . . ".

FIG. 4 is a diagram illustrating a configuration of a smart watch having a strap changing in color according to the user's mood according to a second embodiment of the present invention.

In the following description of the second embodiment of the present invention, detailed descriptions of the same configurations as those of the above-described first embodiment, and configurations that may be easily changed and predicted by the first embodiment are omitted.

The smart watch according to the second embodiment of the present invention is configured to include a smart watch configured with a body 400 and a strap (not shown) and a mobile terminal 300 serving as a master terminal thereof.

The body 400 communicates with the mobile terminal and performs a part of functions of the mobile terminal 300 instead of the mobile terminal 300. The body 400 is configured such that the mobile terminal 300 performs a part or all of procedures of determining the displayed color and an output means 510 is controlled to output the determined displayed color. To this end, the body 400 is configured to include a control unit 410, an output unit 420, an input unit 430, a sensor unit 440, a storage unit 450, an RF unit 460, and the output means 510.

Similar to the first embodiment described above, the second embodiment is controlled to compare the state information determined by measuring the state of the user with predetermined state combination information state combination information, search the combination information included in the state combination information for combination information such as current state information, and determine the displayed color matched to the found combination information as the displayed color of the strap 20.

In the case of the second embodiment, it is noted that the procedure of measuring and analyzing the measurement target that is to be analyzed for the current state of the user may performed in each of the smart watch 400 and the mobile terminal 300 so that the results thereof are compared with each other, a certain procedure is performed in the mobile terminal 300, or most procedures are performed in the mobile terminal 300. That is, in the case of the second embodiment, the process of determining the displayed color is performed through communication between the smart watch 400 and the mobile terminal 300. That is, in this communication process, the measured values for the measurement target may be interchanged, and the processing results may also be interchanged between the smart watch 400 and the mobile terminal 300.

More specifically, as shown in FIG. 4, the smart watch 400 and the mobile terminal 300 is configured to include a control unit 410 and a terminal control unit 310, respectively, and further include an input unit 430 and terminal input unit 330, and a sensor unit 440 and a terminal sensor unit 340, respectively. That is, the state measurement of the user may be performed in both the smart watch 400 and the mobile terminal 300. The smart watch 400 and the mobile terminal 300 may measure the same measurement target and compare the measured values thereof, but may combine and use the information that is measured independently or received from each other when configurations of the respective input units 330 and 430 and the respective sensor units 340 and 440 of the smart watch 400 and the mobile terminal 300 are different from each other.

That is, the body 400 of the smart watch has a camera 432 and a microphone 431 configured in the input unit 430 and only a temperature sensor 441 configured in the sensor unit 440, while the mobile terminal 300 has a camera (not shown) and a microphone (not shown), and a GPS sensor, an acceleration sensor, and a gyro sensor configured in terminal sensor unit 340, so that sensors of different types may be provided. In this case, the data measured by each sensor of the smart watch 400 and the mobile terminal 300 may be used for analyzing the user's state. In particular, when the devices such as a microphone and a camera are configured in both the smart watch 400 and the mobile terminal 300, it is possible to measure the state of the user using an average value of the values measured by the smart watch 400 and the mobile terminal 300 or using the measured value from one of the devices 200 and 300 having a relatively higher performance.

Likewise, the user's state determination and the displayed color determination may be performed by either the smart watch 400 or the mobile terminal 300, or may be performed in both the smart watch 400 and the mobile terminal 300 and then compared. In the case that the state determination and the displayed color determination are performed in both the smart watch 400 and the mobile terminal 300, when the displayed color determined in the smart watch 400 is different from the displayed color determined in the mobile terminal 300, a re-determination procedure is performed or a priority is given to the determination of any one of the devices 300 and 400 so that the displayed color may be determined.

For this purpose, a camera, a microphone, an optical sensor (or an optical sensitivity sensor) may be configured in the respective input units 330 and 430 of the smart watch 400 or the mobile terminal 300, and a pulse sensor, a temperature sensor, an acceleration sensor, a GPS sensor, a gyro sensor, a blood pressure sensor, and any sensor capable of measuring states of the user may be configured in each of or divided into the sensor units 340 and 440 thereof, but the present invention is not limited thereto.

The reference value and the state combination information for determining the grade of the measurement target shown in FIG. 3 may be stored in the respective storage units 350 and 400 of the device 300 or 400, which mainly determine the user's state and the displayed color.

While the present invention has been particularly shown and described with reference to exemplary embodiments thereof, the present invention is not limited to the above-described embodiments, and various modifications may be made without departing from the scope of the present invention. Accordingly, such modifications are deemed to be within the scope of the present invention, and the scope of the present invention should be determined by the following claims.

INDUSTRIAL APPLICABILITY

The smart watch having the strap changing in color according to the user's mood in the present invention may measure the user's mood or state using various methods and change the displayed color of the strap of the wearable auxiliary device according to the user's mood, whereby it is possible to express the individuality of the wearable auxiliary device and divert and improve the user's mood using the displayed color, thereby making it possible to be used as a terminal device for a health care service.

The invention claimed is:

1. A smart watch having a strap changing in color according to a user's mood, the smart watch comprising: a body configured to collect information on a plurality of measurement targets associated with a user or around the user to write state information, wherein the plurality of measurement targets include a face color divided into red normal, and pale, a pupil shape divided into enlarged and reduced, a pulse divided into fast, normal, and slow, a body temperature divided into high, normal, and low, a voice divided into excited and calm, a ambient light divided into bright, normal), and dark, a ambient temperature divided into high, normal, and low, and an activity divided into fast movement, slow movement, and no movement, compare the state information with state combination information that a plurality of pieces of combination information and a displayed color for each of the plurality of pieces of combination information are determined, select one piece of corresponding combination information among the plurality of pieces of combination information included in the state combination information, and select a displayed color matching the selected combination information; and a strap that is connected with the body to fix the body to a user's body part, includes an output means of the displayed color, and outputs the displayed color through the output means according to a control of the body, wherein the body includes a sensor unit configured with at least one of a temperature sensor, a pulse sensor, a blood pressure sensor, an accelerator sensor, a GPS sensor, a gyro sensor, and an optical sensor, or an input device including a camera or a microphone, in order to collect the state information, wherein the body further includes a control unit, in which the control unit receives a measured value obtained by measuring each of a plurality of measurement targets from the sensor unit or the input unit, divides the measured value into grades for each of the measurement targets, combines the measured values divided into grades for each of the measurement targets, and writes the state information, wherein the body further includes a storage unit, in which the storage unit stores a predetermined reference value for each of the measurement targets to be divided into the grades, and the control unit compares the reference value with the measured value to be divided into the grades, wherein the combination information is an expected value of the state information that is computable by combining the grades of the respective measured values for each of the plurality of measurement targets, wherein the state combination information includes the displayed color matching with the one piece of corresponding combination information, so that based on the state combination information, the control unit is configured to switch to one of positive states among good feelings, excitement, and motivation due to exercise in response to a user's current state being one of negative states among anger, depression, and boredom based on the plurality of measurement targets, and configured to maintain the user's current state in response to the user's current state being the one of positive states based on the plurality of measurement targets, wherein the output means is configured to include a light source capable of outputting one or more colors according to the control, a power supply means supplying power to the light source, and a connecting means connecting the light source and the power supply means, and the strap has at least one of the light source, the power supply means, and the connecting means embedded inside or attached to a surface thereof.

2. The smart watch according to claim 1, wherein the strap is formed with a transparent or translucent light guiding material that allows light from the light source to be diffused and emitted from the strap.

3. The smart watch according to claim 1, further comprising an RF unit for performing communication with a mobile terminal of a master device, in which the mobile terminal performs at least one process of the measuring, the dividing of the measured values into grades, the comparison of the state information and the state combination information, and the determination of the displayed color, and the smart watch receives process results from the mobile terminal via the RF unit.

* * * * *